US006623053B1

(12) United States Patent
Hwang

(10) Patent No.: US 6,623,053 B1
(45) Date of Patent: Sep. 23, 2003

(54) INSIDE LOCKING DEVICE OF FLAT HANDLE LOCK

(75) Inventor: Lien-Shi Hwang, Kaohsiung (TW)

(73) Assignee: Taiwan Fu Hsing Industrial Co., Ltd. (TW)

( * ) Notice: Subject to any disclaimer, the term of this patent is extended or adjusted under 35 U.S.C. 154(b) by 0 days.

(21) Appl. No.: 10/119,092

(22) Filed: Apr. 10, 2002

(51) Int. Cl.[7] ..... E05B 3/00
(52) U.S. Cl. ..... 292/336.3; 70/467
(58) Field of Search ..... 292/336.3, 169.17, 292/169.18; 70/467, 468, 473, 476, 478–484

(56) References Cited

U.S. PATENT DOCUMENTS 2,814,194 A * 11/1957 North ..... 70/146
2,950,615 A * 8/1960 Schlage ..... 70/216
3,105,712 A * 10/1963 Duvall ..... 292/169
3,916,656 A * 11/1975 Schlage ..... 70/148
5,941,108 A * 8/1999 Shen ..... 70/467

* cited by examiner

*Primary Examiner*—Gary Estremsky
(74) *Attorney, Agent, or Firm*—Bacon & Thomas, PLLC

(57) ABSTRACT

An inside locking device of a flat handle lock includes an inner handle unit having a fixing disk provided with a sleeve for combination with an inner handle having an elongated shank. The sleeve has an inside provided with a bottom plate, an unlocking plate, a first elastic member, a control cylinder, and a push button. The unlocking plate is received in the control cylinder, and has at least one ear plate locked in at least one guide slot of the control cylinder. The control cylinder is provided with a protruding plate that is locked in a straight slot formed in the sleeve, and the other end of the control cylinder is combined with the push button. The push button protrudes outward from the hole provided in the inner handle.

12 Claims, 6 Drawing Sheets

INSIDE LOCKING DEVICE OF FLAT HANDLE LOCK

BACKGROUND OF THE INVENTION

1. Field of the Invention

The present invention relates to an inside locking device of a flat handle lock, and more particularly to an inside locking device of a flat handle lock, wherein the flat handle lock at the inside of the door plate may be locked in a pressing manner, and has a simpler construction.

2. Description of the Related Art

A conventional handle lock structure in accordance with the prior art is disclosed in U.S. Pat. No. 5,284,372, which is shown in FIG. 1. The conventional handle lock structure comprises an outer handle 81, and an inner handle 82. The inner handle 82 is combined with a sleeve 83 which receives a push button 84, a drive tube 85, and an elastic member 86 therein. The push button 84 may be protruded outward from the hole 821 of the inner handle 82, and may be pressed. The push button 84 is formed with a breach 841 for insertion of the protruding bar 831 of the sleeve 83, so that the push button 84 is limited to move linearly. The push button 84 is formed with an annular groove 842 for hooking the hook 851 of one end of the drive tube 85 whose other end is provided with a rectangular slot 852 and a lug 853. The outer handle 81 has a plate 811 locked in the rectangular slot 852. The lug 853 of the drive tube 85 is locked in the guide channel 832 of the sleeve 83 to perform the linear and rotational operations. When the conventional handle lock structure needs to be locked, the push button 84 is pressed, the lug 853 of the drive tube 85 may be moved in the guide channel 832 of the sleeve 83 linearly, and may be rotated, so that the plate 811 may be rotated, thereby locking the conventional handle lock structure.

In the conventional handle lock structure as shown in FIG. 1, the outer handle 81 is a conventional tubular lock structure, and the inner handle 82 is made by improving the conventional tubular lock, whereby it can be locked by the key, so that the inner handle 82 can be locked by pressing the push button 84. In the conventional handle lock structure as shown in FIG. 1, each of the outer handle 81 and the inner handle 82 has a cylindrical shape, so that the conventional handle lock structure is inconvenient to the handicap. In addition, the shapes of the parts of the push button 84 and the drive tube 85 are more complicated, thereby increasing cost of fabrication. Further, the positioning effect of the push button 84 is not good.

A conventional flat handle lock structure in accordance with the prior art is disclosed in U.S. Pat. No. 5,809,815, which is shown in FIG. 2. The conventional flat handle lock structure comprises an inner handle unit 91, an outer handle unit 92, an unlocking unit 93, and a control unit 94. When the conventional flat handle lock structure is used in the inside of the door plate, the push button 95 may be pressed, so that the hook 952 on the safety bar 951 is locked in the slotted wall 932 of the retractor 931 provided by the unlocking unit 93, thereby forming a locking state. When the conventional flat handle lock structure is used in the outside of the door plate, the correct key 96 may drive the lock core of the lock core unit 97 to rotate, thereby controlling the locking and unlocking actions.

The conventional flat handle lock structure as shown in FIG. 2 is made by improving the tubular lock structure of the conventional flat handle lock. Each of the inner handle unit 91 and the outer handle unit 92 uses the shank-shaped handle, and the unlocking unit 93 adopts the design of the retractor. Thus, The conventional flat handle lock structure as shown in FIG. 2 has a complicated structure.

SUMMARY OF THE INVENTION

The primary objective of the present invention is to provide an inside locking device of a flat handle lock, wherein the handle lock is available for a flat handle, and the handle lock at the inside of the door plate may be locked in a pressing manner.

A secondary objective of the present invention is to provide an inside locking device of a flat handle lock, wherein the flat handle lock has a simpler construction.

In accordance with the present invention, there is provided an inside locking device of a flat handle lock, comprising:

an outer handle unit, having a fixing disk provided with a rotatably outer handle having an elongated shank, the outer handle capable of driving a drive tube to rotate, the outer handle unit having a lock core set that may drive a lock control plate to rotate; and an inner handle unit, having a fixing disk provided with a sleeve, the sleeve having an inside provided with a bottom plate, the outer handle having an elongated shank being combined on the sleeve, the inside of the sleeve receiving an unlocking plate, a first elastic member, a control cylinder, and a push button, one end of the push button protruding outward from a hole provided in the inner handle, the unlocking plate being received in the control cylinder from one end of the control cylinder, the unlocking plate having a drive hole for passage of one end of the lock control plate, the unlocking plate being provided with at least one ear plate locked in at least one guide slot of the control cylinder, the guide groove having two ends each having an annular groove parallel with the end of the control cylinder, the control cylinder being provided with a protruding plate that is locked in a straight slot formed in the sleeve, the other end of the control cylinder being combined with the push button, one end of the first elastic member being rested on the unlocking plate, and the other end of the first elastic member pushing a wall of an inner end of the control cylinder.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
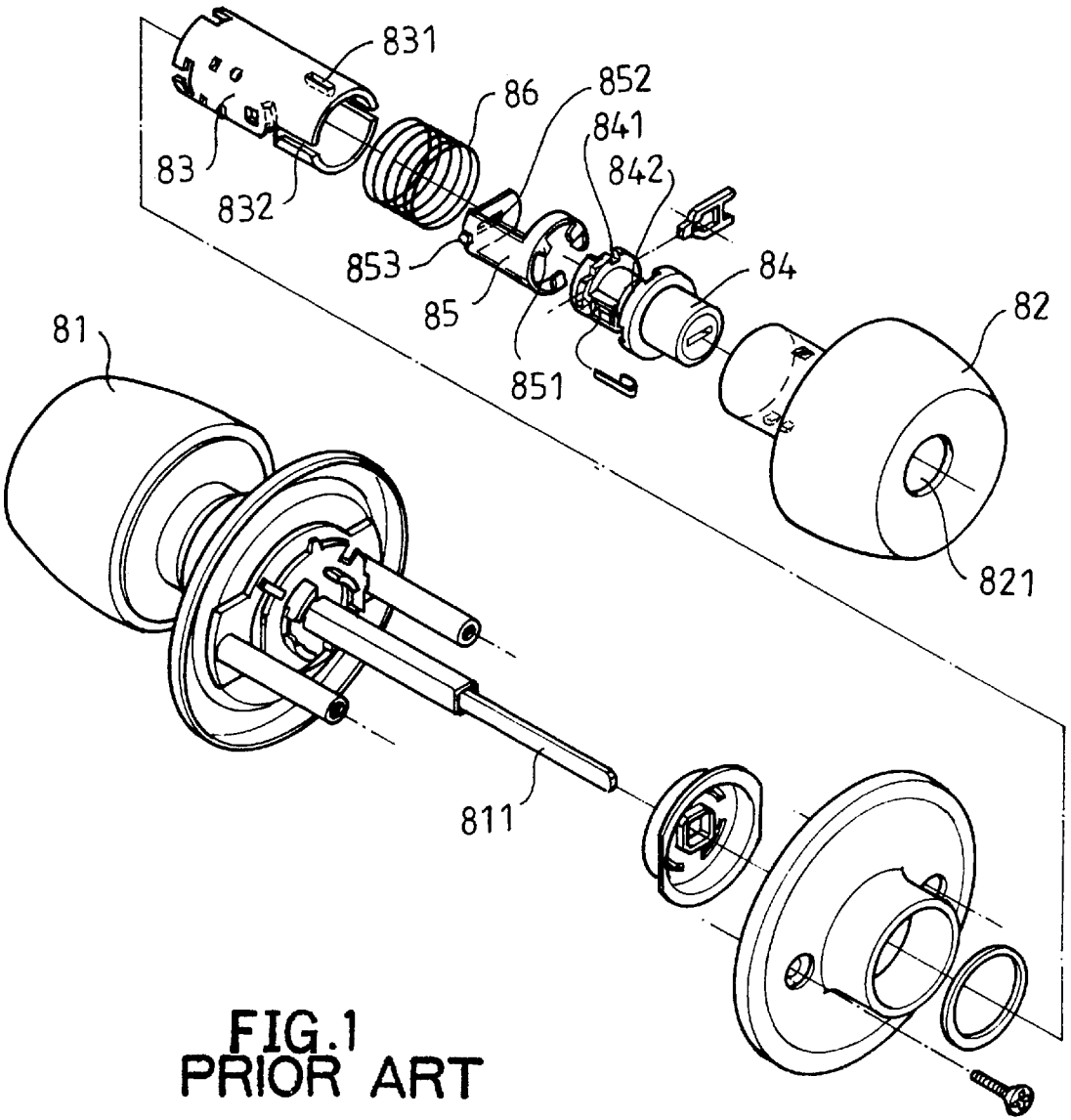
FIG.1 PRIOR ART
FIG. 1 is an exploded perspective view of a first conventional handle lock in accordance with the prior art.
Figure 2:
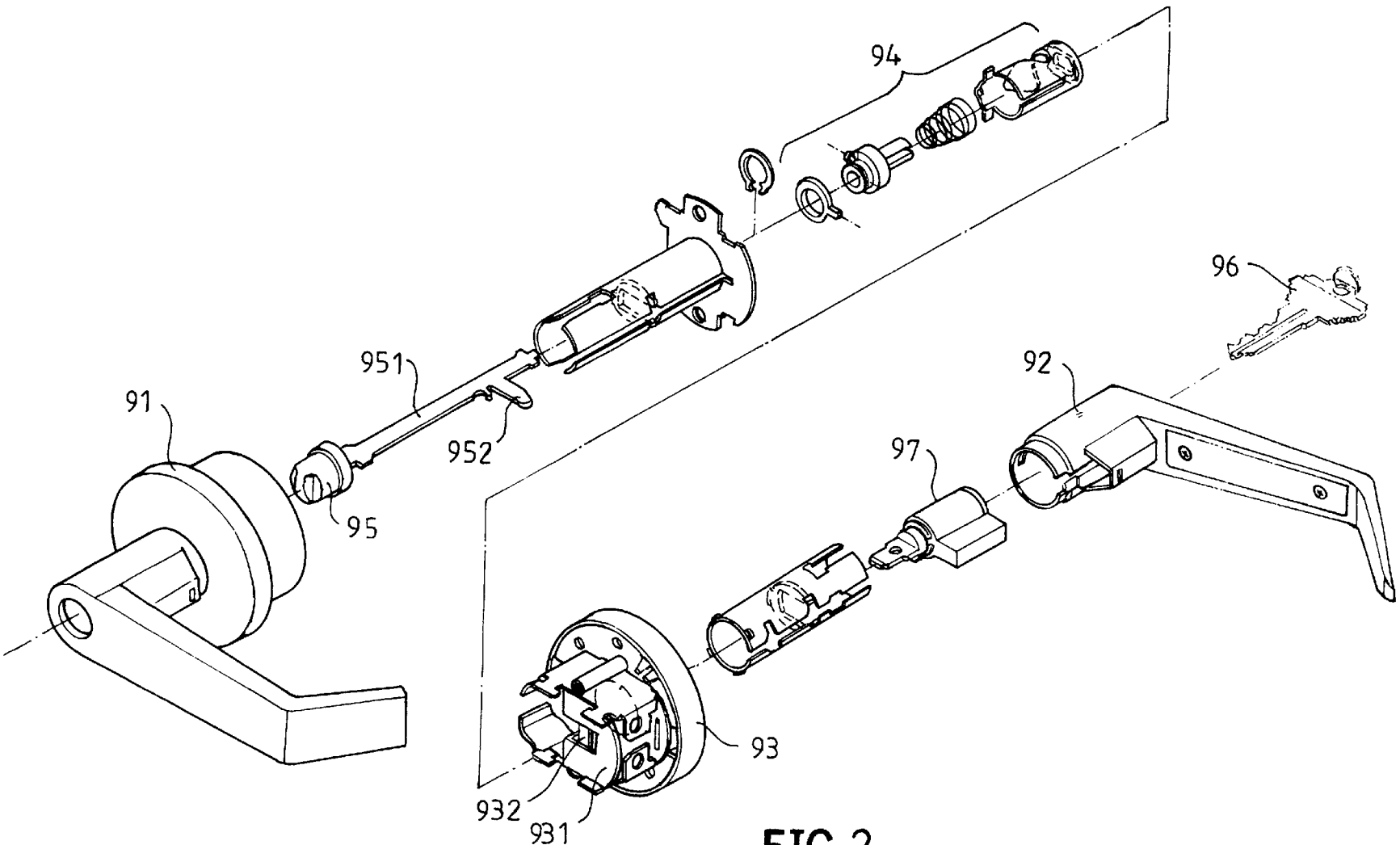
FIG. 2 PRIOR ART
FIG. 2 is an exploded perspective view of a second conventional handle lock in accordance with the prior art.
Figure 3:
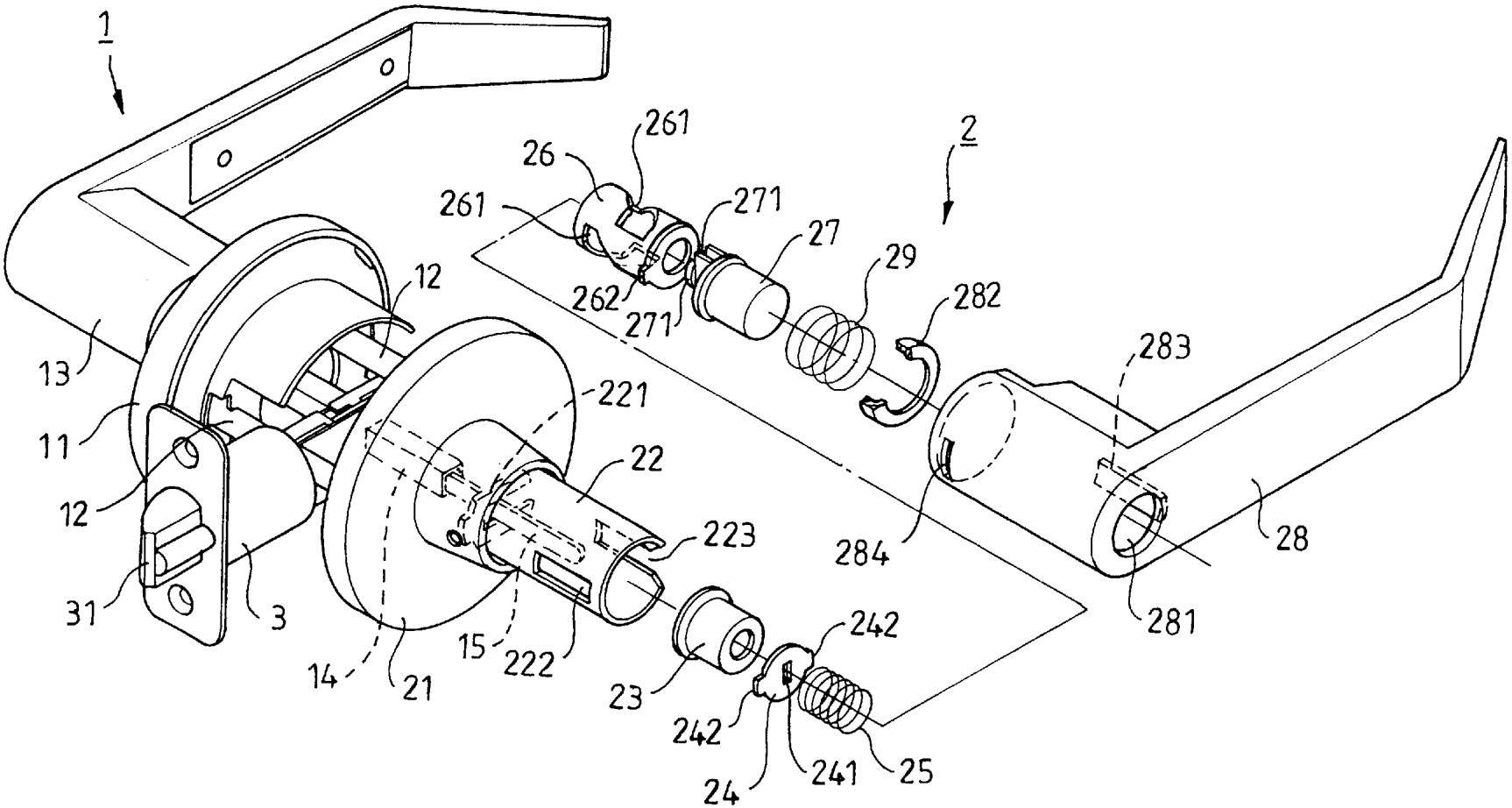
FIG. 3 is an exploded perspective view of an inside locking device of a flat handle lock in accordance with a preferred embodiment of the present a- invention.

Referring to the drawings and initially to FIG. 3, an inside locking device of a flat handle lock in accordance with a preferred embodiment of the present invention comprises an outer handle unit 1, an inner handle unit 2, and a lock latch 3.

The structure of the outer handle unit 1 is the same as that of the conventional outer handle unit, and includes a fixing disk 11 provided with posts 12 fixed on the door plate. An outer handle 13 having an elongated shank may be rotatably mounted on the fixing disk 11, to drive a drive tube 14 to rotate. The drive tube 14 is extended through the drive wheel of the lock latch 3, to draw the lock tongue 31 of the lock latch 3 to operate. The drive tube 14 is provided with a lock control plate 15 whose one end is combined on the lock core set 16 (see FIG. 4) of the outer handle unit 1, whereby the correct key may drive the lock core of the lock core set 16, so that the lock control plate 15 may be driven to rotate, so as to unlock the flat handle lock.

The inner handle unit 2 includes a fixing disk 21 that may be rested on the inside of the door plate, and may be combined with the fixing disk 11 of the outer handle unit 1 by bolts screwed into the posts 12, so that the outer handle unit 1 and the inner handle unit 2 may be fixed on the outside and inside of the door plate. The fixing disk 21 of the inner handle unit 2 is provided with a sleeve 22 which has an inside that may receive a support cylinder 23, an unlocking plate 24, a first elastic member 25, a control cylinder 26, a push button 27, and a second elastic member 29. An inner handle 28 having an elongated shank may be combined on the outside of the sleeve 22. For positioning the parts combined in the sleeve 22, the inside of the sleeve 22 is provided with a bottom plate 221 that may protrude from the surface of the sleeve 22. The support cylinder 23 has a first end rested on the bottom plate 221, and a second end on which the unlocking plate 24 is rested. The first elastic member 25 has a first end rested on the unlocking plate 24, and a second end rested on the control cylinder 26. The unlocking plate 24 has a non-circular drive hole 241 for passage of the lock control plate 15, so that the unlocking plate 24 and the lock control plate 15 may drive each other mutually. The unlocking plate 24 is provided with two opposite ear plates 242 each protruding outward. The control cylinder 26 is provided two guide grooves 261, so that the two ear plates 242 may be locked into the two guide grooves 261 respectively. Each of the two guide grooves 261 is a substantially helical oblique groove, so that the unlocking plate 24 may be rotated in the two guide grooves 261. Each of the two guide grooves 261 has two ends each having an annular groove parallel with the end of the control cylinder 26, so that after the unlocking plate 24 is rotated in the two guide grooves 261, the unlocking plate 24 may be retained in the two ends of the guide groove 261. The control cylinder 26 is provided with a protruding plate 262 that may be locked into a straight slot 222 formed in the sleeve 22, so that the control cylinder 26 is limited to move in the straight slot 222 of the sleeve 22 linearly. One end of the control cylinder 26 is mounted on the support cylinder 23, so that the control cylinder 26 may be moved stably. The other end of the control cylinder 26 is provided with a locking hole 263 into which the locking hooks 271 of the push button 27 may be snapped, so that the push button 27 may push the control cylinder 26 to move, and when the control cylinder 26 is pushed by the first elastic member 25 to return to its original position, the push button 27 may also return to its original position to protrude from the hole 281 of the inner handle 28. The periphery of the hole 281 of the inner handle 28 is provided with a washer 282, so that the control cylinder 26 may have better stability during movement. The washer 282 is pushed by one end of the second elastic member 29. The other end of the second elastic member 29 is rested on the push button 27. The inner handle 28 is provided with a protruding block 283 and a locking slot 284. The protruding block 283 may be locked in the opened channel 223 of the sleeve 22, and the bottom plate 221 protruding from the surface of the sleeve 22 may be locked in the locking slot 284, so that the inner handle 28 may drive the sleeve 22 to rotate.

Figure 4:
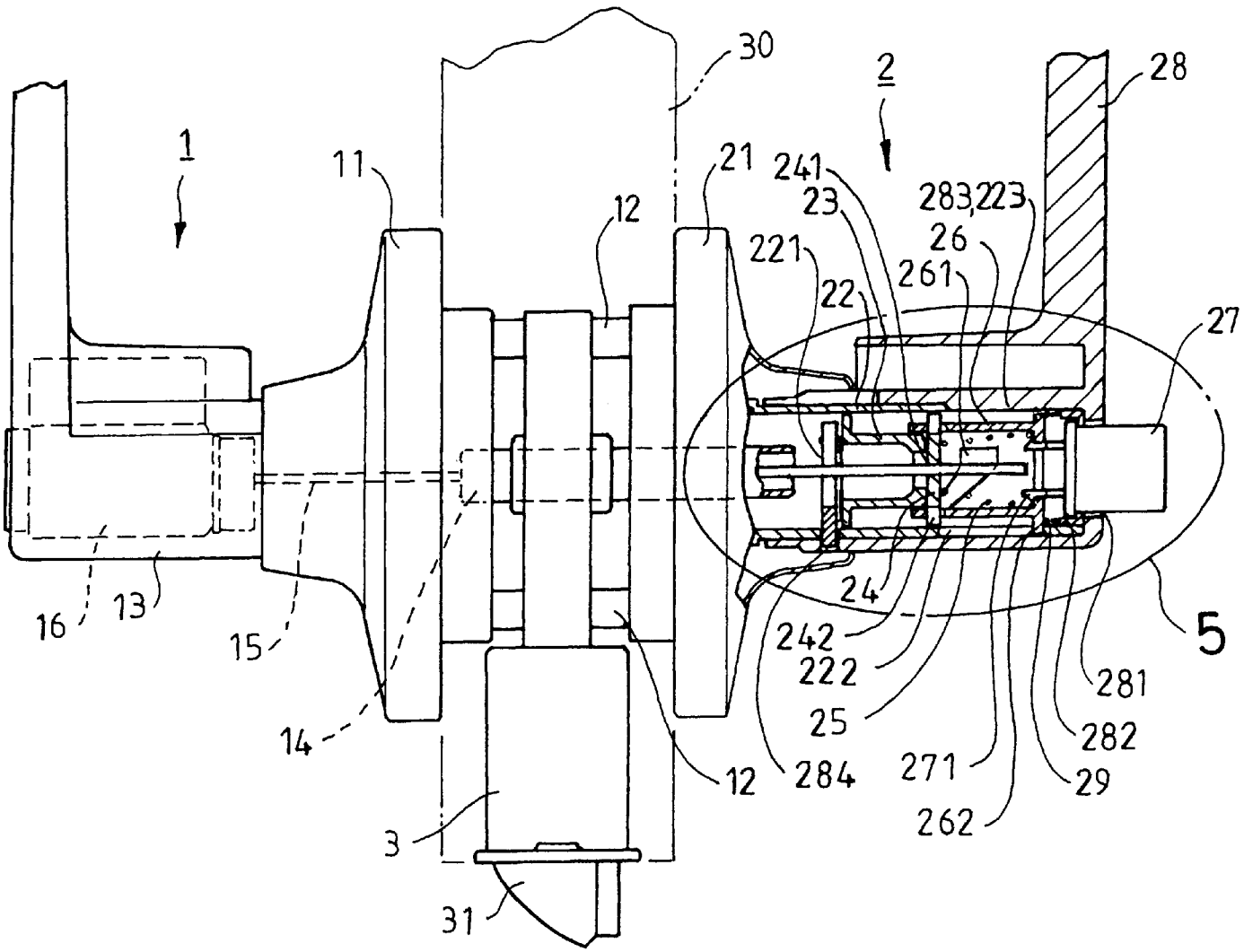
FIG. 4 is a partially cross-sectional assembly view of the inside locking device of a flat handle lock as shown in FIG. 3.

Referring to FIG. 4, the inside locking device of a flat handle lock in accordance with the preferred embodiment of the present invention is assembled. The fixing disk 11 of the outer handle unit 1 and the fixing disk 21 of the inner handle unit 2 may be rested on the outside and inside of the door plate 30 respectively. The lock latch 3 is placed in the door plate 30. The inner handle unit 2 may be combined with the outer handle unit 1 by bolts screwed into the posts 12 of the outer handle unit 1. The lock core set 16 provided by the outer handle unit 1 is mounted on one end of the lock control plate 15 whose other end is extended through the drive tube 14 and the unlocking plate 24. The drive tube 14 is extended through the drive wheel of the lock latch 3, to draw the lock tongue 31 of the lock latch 3 to operate.

Figure 5:
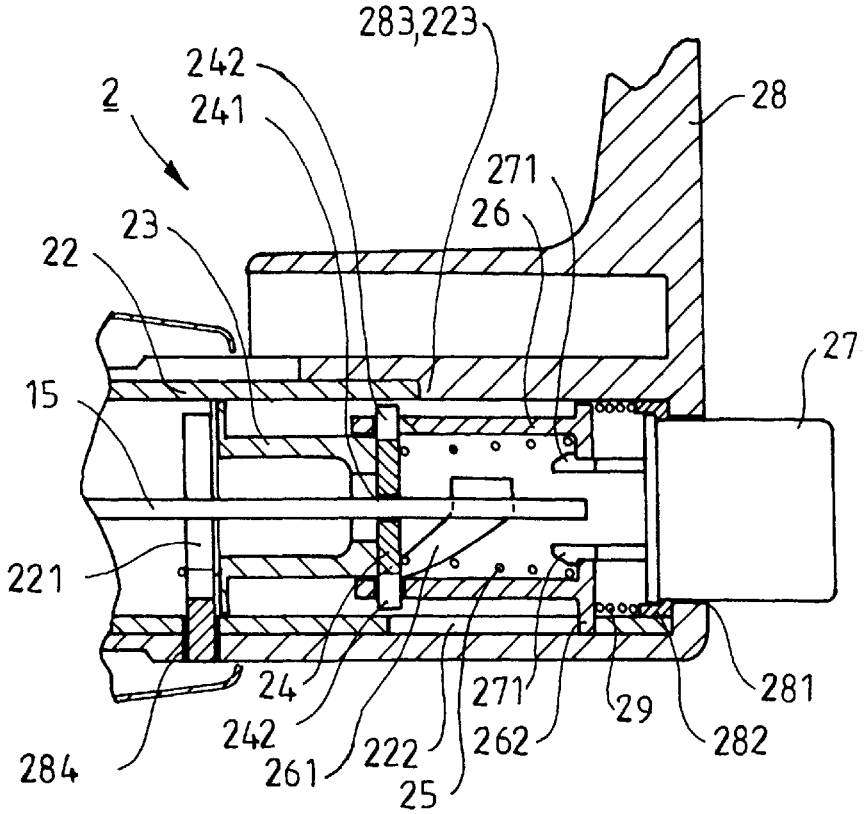
FIG. 5 is a locally enlarged view of the inside locking device of a flat handle lock as shown in FIG. 4.

FIG. 5 is a locally enlarged view of the inside locking device of a flat handle lock as shown in FIG. 4. As shown in FIG. 5, the push button 27 largely protrudes outward from the hole 281 of the inner handle 28. At this time, the larger face of the lock control plate 15 is vertical to the plane of FIG. 5, so that the inside locking device of the flat handle lock is disposed at an unlocking situation. At this time, the control cylinder 26 is pushed by the first elastic member 25, so that each of the two ear plates 242 of the unlocking plate 24 is located at the left-side annular groove (according to the plane of FIG. 5) of each of the two guide grooves 261 of the control cylinder 26.

Figure 6:
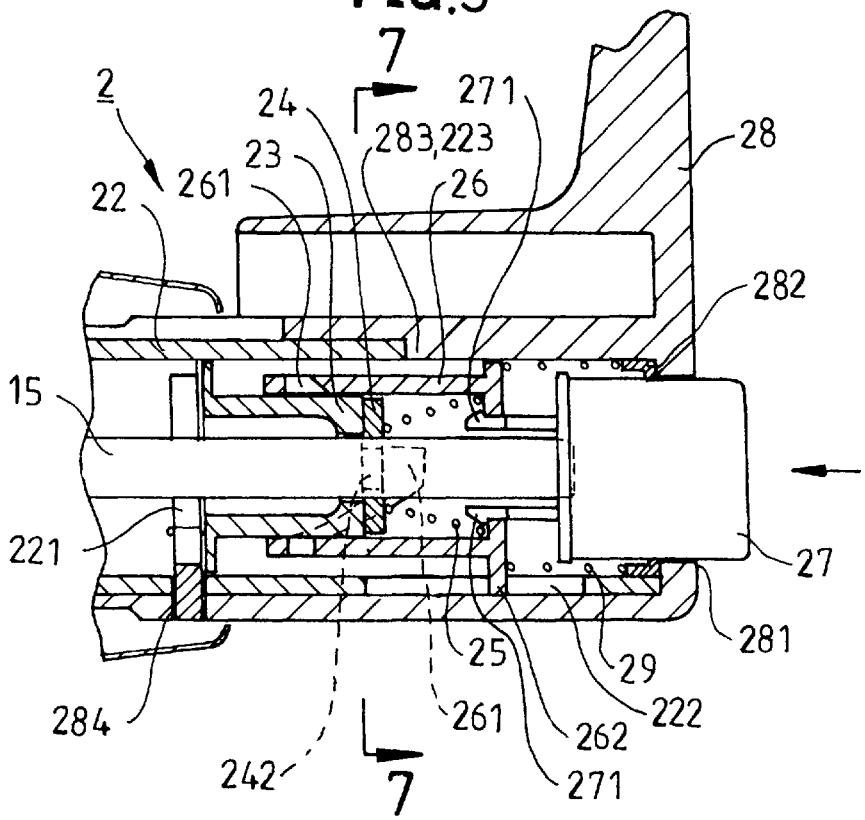
FIG. 6 is a schematic operational view of the inside locking device of a flat handle lock as shown in FIG. 5.

Referring to FIG. 6, the push button 27 as shown in FIG. 5 is pressed inward, so that the inside locking device of the flat handle lock is disposed at a locking situation. When the push button 27 as shown in FIG. 5 is pressed inward, the push button 27 may push the control cylinder 26 to move. The protruding plate 262 of the control cylinder 26 is limited by the straight slot 222 formed in the sleeve 22, so that the control cylinder 26 is limited to move in the straight slot 222 of the sleeve 22 linearly. When the control cylinder 26 is moved, each of the two ear plates 242 of the unlocking plate 24 is locked in each of the two guide grooves 261 of the control cylinder 26 respectively. Each of the two guide grooves 261 is a substantially helical oblique groove, so that the unlocking plate 24 may be rotated through 90 degrees, and each of the two ear plates 242 of the unlocking plate 24 is located at the right-side annular groove (according to the plane of FIG. 6) of each of the two guide grooves 261 of the control cylinder 26. At this time, the lock control plate 15 is driven by the unlocking plate 24 to rotate through 90 degrees, so that the inside locking device of the flat handle lock is disposed at a locking situation.

Figure 7:
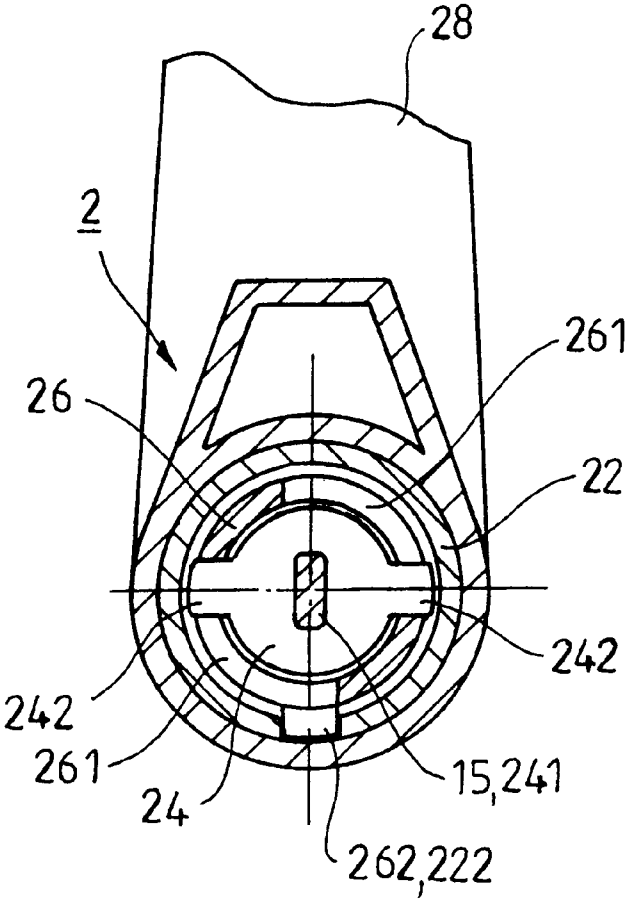
FIG. 7 is a cross-sectional view of the inside locking device of a flat handle lock taken along line 7—7 as shown in FIG. 6.

FIG. 7 is a cross-sectional view of the inside locking device of a flat handle lock taken along line 7—7 as shown in FIG. 6. At this time, the inside locking device of the flat handle lock is disposed at a locking situation. Thus, each of the two ear plates 242 of the unlocking plate 24 is locked in each of the two guide grooves 261 of the control cylinder 26, the unlocking plate 24 has a drive hole 241 for passage of the lock control plate 15, and the protruding plate 262 of the control cylinder 26 is locked in the straight slot 222 formed in the sleeve 22.

Figure 8:
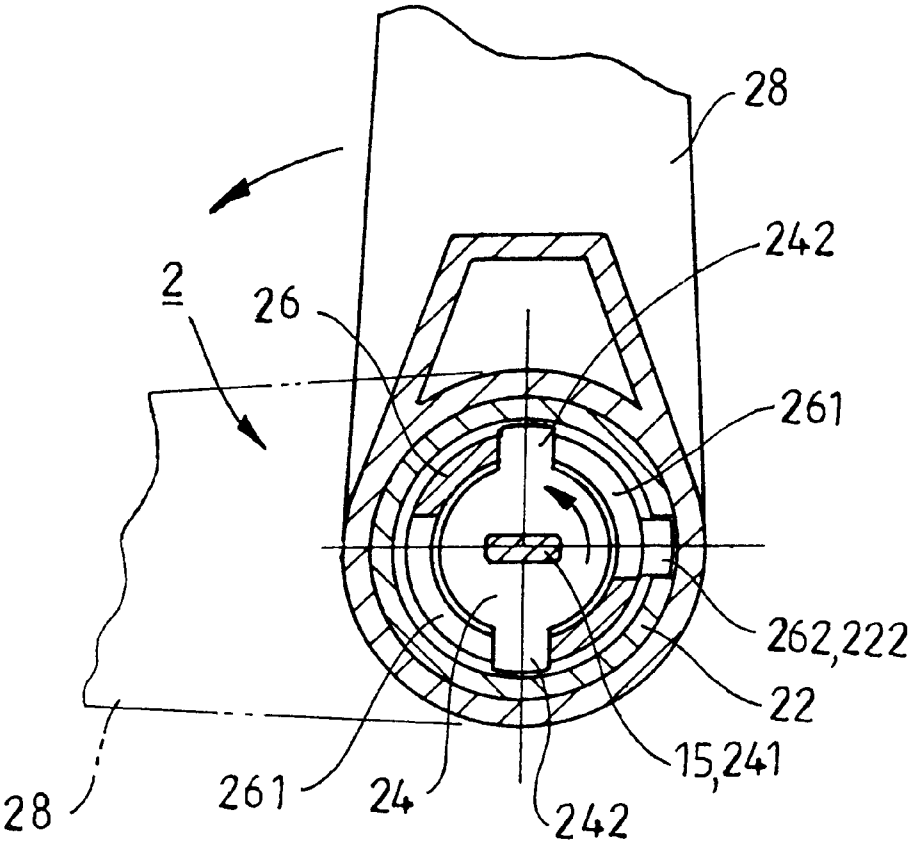
FIG. 8 is a schematic operational view of the inside locking device of a flat handle lock as shown in FIG. 7.

Referring to FIG. 8, when the inside locking device of a flat handle lock as shown in FIG. 7 is to be transferred from a locking situation to an unlocking situation, the correct key may drive the lock core of the lock core set 16 from the outer handle unit 1, so that the lock control plate 15 may be driven to rotate. Thus, the lock control plate 15 may drive the unlocking plate 24 to rotate, whereby each of the two ear plates 242 of the unlocking plate 24 may be moved in each of the two guide grooves 261 of the control cylinder 26, so that the push button 27 may be pushed by the first elastic member 25 to return to its original position, thereby forming an open state. Alternatively, the inner handle 28 of the inner handle unit 2 may be rotated directly, so that the inner handle 28 of the inner handle unit 2 may directly drive the sleeve 22 to rotate. When the sleeve 22 is rotated, the protruding plate 262 of the control cylinder 26 is locked in the straight slot 222 of the sleeve 22, so that the control cylinder 26 may be driven to move simultaneously. Each of the two ear plates 242 of the unlocking plate 24 is locked in each of the two guide grooves 261 of the control cylinder 26, whereby each of the two ear plates 242 of the unlocking plate 24 is pressed by the wall of each of the two guide grooves 261 of the control cylinder 26, so that the unlocking plate 24 may be rotated. Thus, the unlocking plate 24 may drive the lock control plate 15 to rotate, so that the inside locking device of the flat handle lock is disposed at an unlocking situation.

Accordingly, the inside locking device of a flat handle lock in accordance with a preferred embodiment of the present invention has a simpler construction. In addition, the handle lock in accordance with a preferred embodiment of the present invention may be available for a flat handle, thereby facilitating the child or the handicap using the handle lock.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An inside locking device of a flat handle lock, comprising:

an outer handle unit, having a fixing disk provided with a rotatable outer handle, the outer handle capable of driving a drive tube to rotate, the outer handle unit having a lock core set that may drive a lock control plate to rotate; and an inner handle unit, having a fixing disk provided with a sleeve, the sleeve having an inside provided with a bottom plate, the outer handle having an elongated shank being combined on the sleeve, the inside of the sleeve receiving an unlocking plate, a first elastic member, a control cylinder, and a push button, one end of the push button protruding outwards from a hole provided in the inner handle, the unlocking plate being received in the control cylinder from one end of the control cylinder, the unlocking plate having a drive hole for passage of one end of the lock control plate, the unlocking plate being provided with at least one ear plate locked in at least one guide slot of the control cylinder, the guide slot having two ends each having an annular groove parallel with the end of the control cylinder, the control cylinder being provided with a protruding plate that is locked in a straight slot formed in the sleeve, the other end of the control cylinder being combined with the push button, one end of the first elastic member being rested on the unlocking plate, and the other end of the first elastic member pushing a wall of an inner end of the control cylinder.

2. The inside locking device of a flat handle lock as claimed in claim 1, wherein the drive tube of the outer handle unit is extended through the drive wheel of the lock latch, to draw the lock tongue of a lock latch to operate.

3. The inside locking device of a flat handle lock as claimed in claim 1, wherein the outer handle unit is provided with posts, so that bolts may be screwed into the posts from the inner handle unit.

4. The inside locking device of a flat handle lock as claimed in claim 1, wherein the inside of-the sleeve receives a support cylinder, one end of the support cylinder is rested on the bottom plate, and the control cylinder is mounted on the other end of the support cylinder.

5. The inside locking device of a flat handle lock as claimed in claim 1, wherein the bottom plate protrudes from a surface of the sleeve, and the inner handle is provided with a locking slot for locking the protruding bottom plate.

6. The inside locking device of a flat handle lock as claimed in claim 1, wherein the sleeve is provided with an opened channel, and the inner handle is provided with a protruding block that may be locked in the opened channel of the sleeve.

7. The inside locking device of a flat handle lock as claimed in claim 1, wherein a periphery of a hole of the inner handle is provided with a washer which is pushed by one end of the second elastic member, and the other end of the second elastic member is rested on the push button.

8. An inner handle unit of a flat handle lock, comprising:

a fixing disk, provided with a sleeve, the sleeve having an inside provided with a bottom plate, an unlocking plate, a first elastic member, a control cylinder, and a push button, the unlocking plate being received in the control cylinder from one end of the control cylinder, the unlocking plate having a drive hole, the unlocking plate being provided with at least one ear plate locked in at least one guide slot of the control cylinder, the guide slot having two ends each having an annular groove parallel with the end of the control cylinder, the control cylinder being provided with a protruding plate that is locked in a straight slot formed in the sleeve, the other end of the control cylinder being combined with the push button, one end of the first elastic member being rested on the unlocking plate, and the other end of the first elastic member pushing a wall of an inner end of the control cylinder; and an inner handle, having an elongated shank and combined on the sleeve, the inner handle provided with a hole, so that one end of a push button protrudes outwards from the hole provided in the inner handle.

9. The inner handle unit of a flat handle lock as claimed in claim 8, wherein the inside of the sleeve receives a support cylinder, one end of the support cylinder is rested on the bottom plate, and the control cylinder is mounted on the other end of the support cylinder.

10. The inner handle unit of a flat handle lock as claimed in claim 8, wherein the bottom plate protrudes from a surface of the sleeve, and the inner handle is provided with a locking slot for locking the protruding bottom plate.

11. The inner handle unit of a flat handle lock as claimed in claim 8, wherein the sleeve is provided with an opened channel, and the inner handle is provided with a protruding block that may be locked in the opened channel of the sleeve.

12. The inner handle unit of a flat handle lock as claimed in claim 8, wherein a periphery of a hole of the inner handle is provided with a washer which is pushed by one end of the second elastic member, and the other end of the second elastic member is rested on the push button.

* * * * *